US007140372B2

(12) United States Patent
Byun

(10) Patent No.: US 7,140,372 B2
(45) Date of Patent: Nov. 28, 2006

(54) COSMETICS CASE

(76) Inventor: Young-Kwang Byun, 928-1005, Mok-dong APT, 312, Shinjeong-dong, Yangcheon-ku, Seoul 158-769 (KR)

( * ) Notice: Subject to any disclaimer, the term of this patent is extended or adjusted under 35 U.S.C. 154(b) by 471 days.

(21) Appl. No.: 10/673,428

(22) Filed: Sep. 30, 2003

(65) Prior Publication Data

US 2004/0206370 A1 Oct. 21, 2004

(30) Foreign Application Priority Data

Apr. 15, 2003 (KR) ..... 10-2003-0023582

(51) Int. Cl.
*A45D 33/20* (2006.01)

(52) U.S. Cl. ..... 132/287; 132/297

(58) Field of Classification Search ..... 132/287, 132/294, 295, 297, 313, 317; 401/123, 125; 206/229, 581, 823
See application file for complete search history.

(56) References Cited

U.S. PATENT DOCUMENTS

| | | | | |
|---|---|---|---|---|
| 254,971 | A * | 3/1882 | Polin et al. | 384/459 |
| 1,172,293 | A * | 2/1916 | Kohlhepp | 401/102 |
| 2,010,521 | A * | 8/1935 | Kreisler | 220/259.2 |
| 2,552,714 | A * | 5/1951 | Gardiner | 401/18 |
| 4,562,923 | A * | 1/1986 | Katada et al. | 206/235 |
| 6,298,863 | B1 * | 10/2001 | Byun | 132/294 |
| 6,978,790 | B1 * | 12/2005 | Byun | 132/287 |

* cited by examiner

*Primary Examiner*—Cris L Rodriguez
*Assistant Examiner*—Rachel A. Running
(74) *Attorney, Agent, or Firm*—Birch, Stewart, Kolasch and Birch, LLP

(57) ABSTRACT

A cosmetics case including a receptacle disposed on an upper level thereof for the cosmetics and a receiving drawer for a cosmetic set disposed in a lower level thereof, whereby when the user pushes a locking holder on an exterior, front wall thereof, a cover for the cosmetic set is opened and simultaneously with the receiving drawer for easily and conveniently accommodating the contents of the cosmetic case.

2 Claims, 4 Drawing Sheets

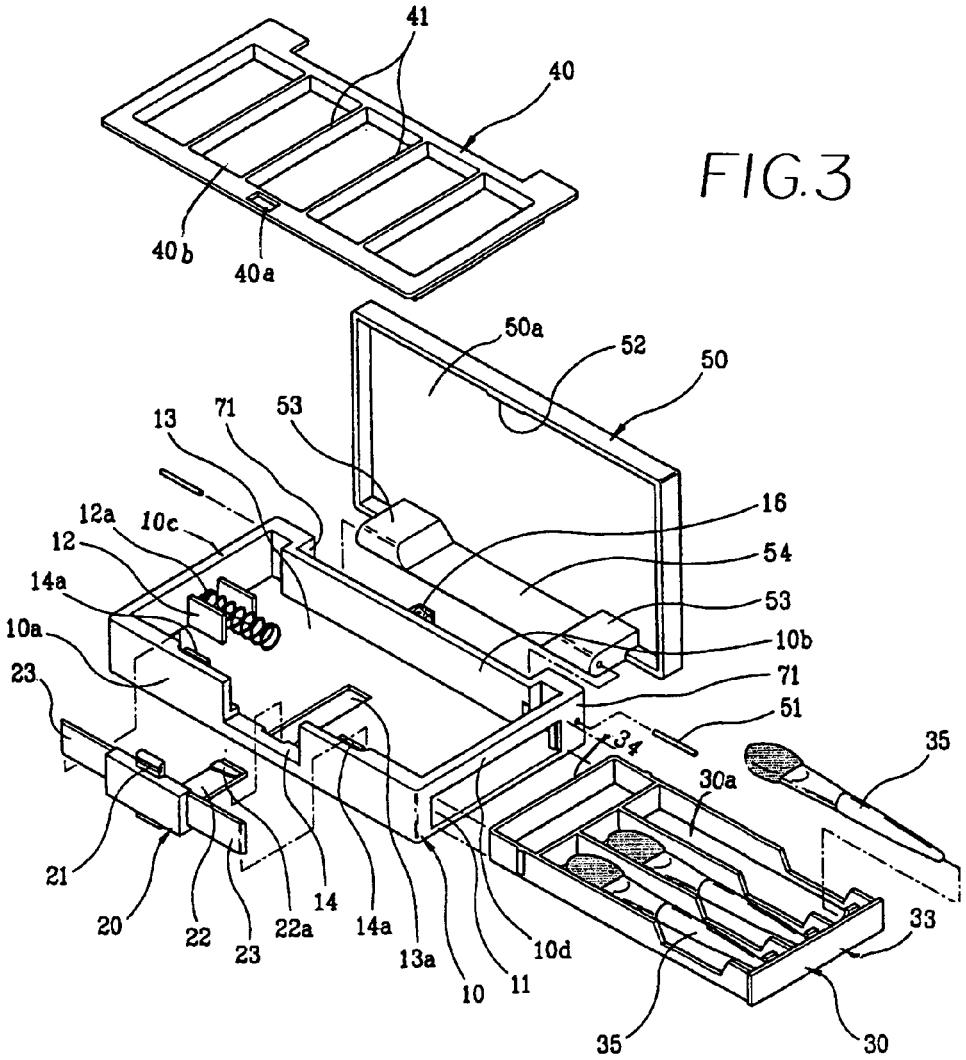
FIG.3
FIG.4
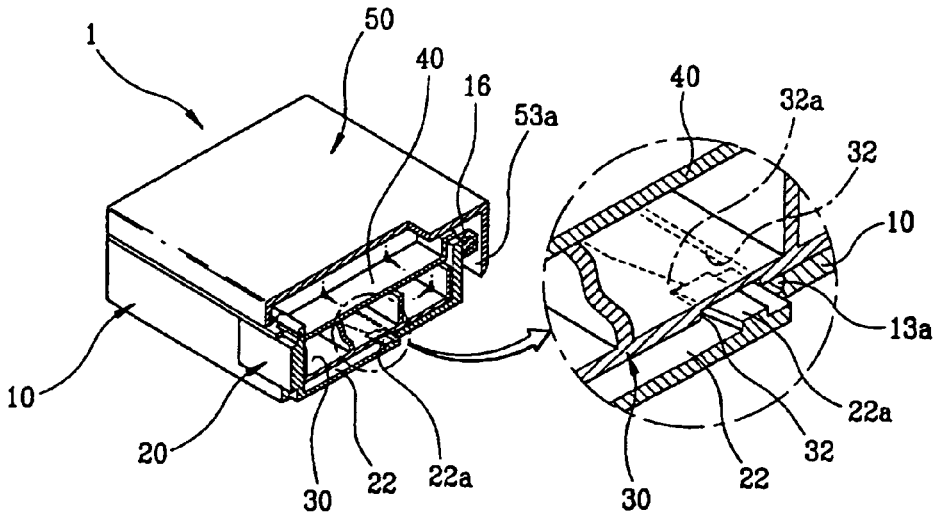

COSMETICS CASE

BACKGROUND OF THE INVENTION

This non-provisional application claims priority under 35 U.S.C. § 119(a) based on Patent Application No. 2003-0023582 filed in Korea on Apr. 15, 2003, the subject matter of which is herein incorporated by reference.

1. Field of the Invention

The present invention relates to a cosmetics case and more particularly, to an improved cosmetics case including a receptacle for the cosmetics and a cosmetic set receiving drawer disposed under the receptacle, whereby when the user pushes a locking holder thereof, the top (cover) of the cosmetic case is opened and the cosmetic set receiving drawer is simultaneously opened for easily and conveniently providing access to the contents of the cosmetic case.

2. Description of Related Art

Various types of cosmetics cases are well known in the art. Generally, a conventional cosmetics case includes a plurality of compartments for containing a number of cosmetics and cosmetic devices disposed in the compartments.

However, such conventional cosmetic cases suffer from a number of problems. For example, when such a conventional cosmetic case is carried in a handbag, movement of the handbag can cause the cosmetics and the cosmetic set to mix together, creating a mess. Also, the cosmetic implements may be damaged by colliding with each other.

In order to solve such problems, the user has used separate accommodations for cosmetics and cosmetic devices. However, it is difficult and inconvenient in certain situations to apply make-up by utilizing two separate cases, for example, when riding in moving cars, ships or airplanes. In such situations, the user encounters difficulty in effectively utilizing two separate cases, which require enhanced dexterity in opening and closing the two cases.

SUMMARY OF THE INVENTION

Accordingly, it is an object of the present invention to provide a cosmetics case which eliminates the above problems encountered with conventional cosmetics cases.

Another object of the present invention is to provide an improved cosmetics case including a receptacle for the cosmetics and a separate cosmetic appliance receiving drawer disposed under the receptacle for conveniently carrying the cosmetic case in a handbag and accessing the contents thereof.

A further object of the present invention is to provide a cosmetics case which includes a housing having a cover to be opened by the operation of a locking holder, an upper level, and a low level, the upper level containing a plurality of compartments for accommodating various types of cosmetics, and the low level containing a hollow compartmented drawer for smoothly accessing cosmetic implements stored therein by pushing the locking holder disposed on the exterior of the front wall of the housing.

Still another object of the present invention is to provide a cosmetics case which is simple in structure, inexpensive to manufacture, durable in use, and refined in appearance.

Briefly described, the present invention is directed to a cosmetics case having at least two levels with a receptacle disposed at the upper level thereof for accommodating cosmetics and a receiving drawer for accommodating cosmetic implements, e.g. scissors, brushes, fingernail file, etc., disposed at the lower level thereof, whereby when the user, by pushing a locking holder on the exterior front wall thereof causes the cover thereof to open, and the receiving drawer to simultaneously slide out for easily and conveniently accessing the contents of the cosmetic case.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3 is an explored perspective view of the cosmetics case, according to the present invention;

FIG. 4 is a perspective view of the locking holder of the cosmetic case of the present invention, showing the detailed construction of the locking holder with an enlarged detailed view thereof;

DETAILED DESCRIPTION OF THE PREFERRED EMBODIMENTS

Figure 1:
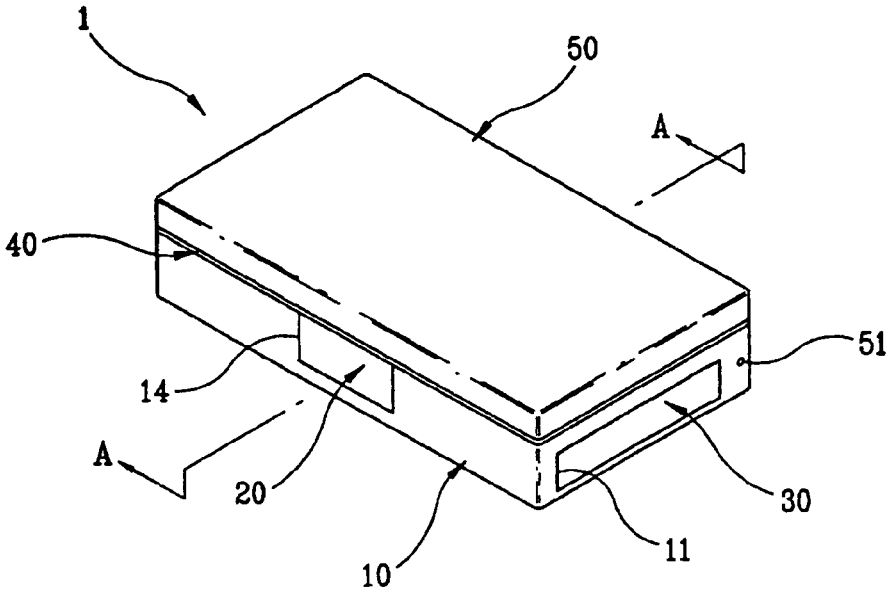
FIG. 1 is a perspective view of a cosmetics case according to the present invention.
Figure 2:
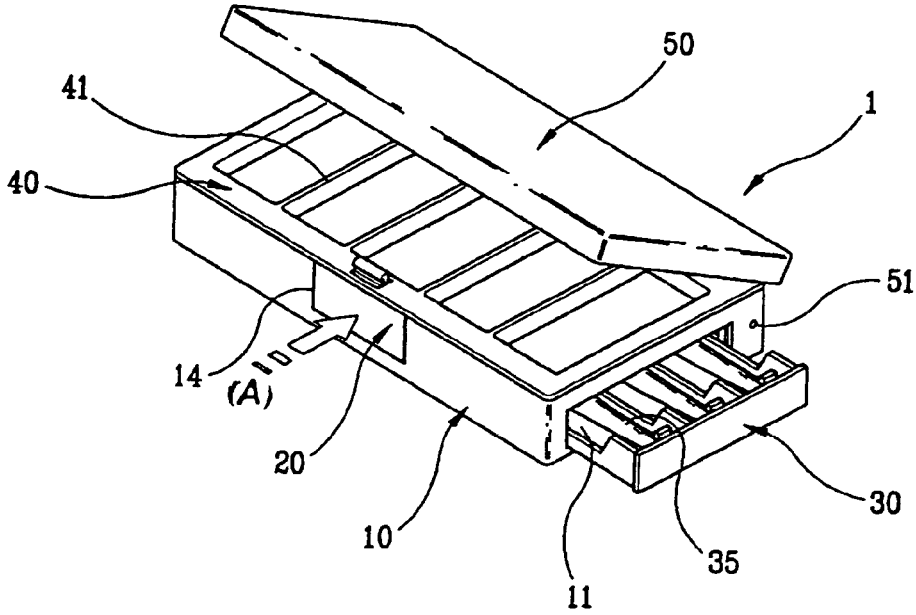
FIG. 2 is a perspective view of a cosmetic case of FIG. 1 in an opened position when the locking holder is pushed by the user.

Referring now in detail to the drawings for the purpose of illustrating the preferred embodiments of the present invention, the cosmetics case 1 as shown in FIGS. 1, 2 and 3, includes a housing 10 containing a receptacle 40 for storing cosmetics said receptacle being disposed on in an upper level of the housing. A drawer 30 is disposed in a lower level of the housing for accommodating a cosmetic set 35. A locking holder 20 is disposed on a front wall 10*a* thereof, and a cover 50 is pivotally mounted to the housing 10 through a pair of pivot pins 51.

The receptacle 40 contains an aperture 40*a* disposed on the front center thereof, a plurality of cosmetics receiving compartments 40*b* for storing various types of colorful cosmetics (not shown) defined by a plurality of partitions 41, and a pair of extensions 42 extending from both ends of the rear portion thereof for fitting the receptacle 40 on the upper level of the housing 10. The cover 50 is provided with a mirror 50*a* adhered to the inside thereof, and a connecting plate 54 having a pair of pivot pin holders 53 disposed on both ends of the connecting plate 54. The pair of pivot pins 51 are disposed in a pin shaft receivers 71 in the rear wall 10*b*, respectively, for pivotably mounting the cover 50 to the housing 10.

As shown in FIG. 3, the drawer 30 for housing cosmetic implements 35 containing a plurality of cosmetic compartments 30*a* for storing various types of cosmetic tools which make up the cosmetic set 35. That is, the drawer 30 is stored in a receiving room 13 of the housing 10 through an entrance 11 disposed at the right wall 10*d* of the housing 10.

Figure 5:
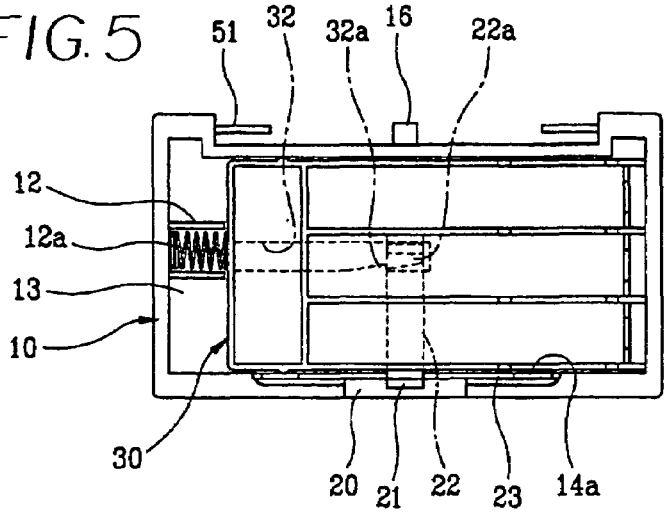
FIG. 5 is a top plan view of the housing of the cosmetic case without the cover, according to the present invention.

Referring in detail to FIGS. 3 and 4, the receiving room 13 includes a pair of walls 12 disposed on the bottom thereof and extending from the middle portion of a left wall 10*c* for containing an elastic spring 12*a*. A groove 13*a* is disposed on the bottom of room 13 and extends from the middle portion of the front wall 10*a*. An opening spring part 16 is disposed on the exterior of the rear wall 10*b*. A locking holder seat 14 is disposed at the center of the front wall 10*a* with a pair of biased elements 14*a*. The locking holder 20 includes a locking hook 21 disposed on the top thereof, a pair of elastic wedges 23 extending from both ends thereof, and a key plate 22 extending from the back side thereof. The key plate 22 has a key projection 22*a* disposed on the end portion thereof for overcoming and locking a stopper 32*a* of the drawer 30 (FIG. 5). When the locking holder 20 is engaged with the locking holder seat 14 of the housing 10, the pair of elastic wedges 23 are engaged with the pair of biased elements 14*a*, and the key plate 22 is engaged with the groove 13*a* of the housing 10, respectively.

Figure 6:
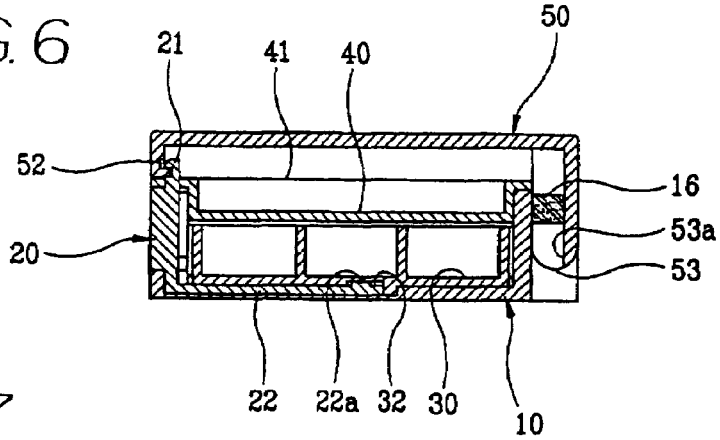
FIG. 6 is a cross-sectional view, taken along line A—A of FIG. 1.

As shown in FIGS. 4, 5 and 6, the drawer 30 furthermore includes a guiding groove 32 having stopper 32*a* disposed on the exterior of the bottom thereof for guiding the key projection 22*a*. Therefore, when the drawer 30 is pushed toward the entrance 11 of the housing, the stopper 32*a* is stopped at the key projection 22*a* of the locking holder 20, and the drawer presses against the bias of the elastic spring 12*a*.

Referring to FIGS. 1–4, the cosmetics case 1 for automatically and simultaneously opening the cover 50 and discharging the drawer 30 containing the cosmetic set 35, according to the present invention, operates as follows. As shown in FIG. 1, the cosmetics case 1 stores the cosmetics (not shown) in the cosmetics receiving room 40*b* and the components of the cosmetic set 35 are stored in the drawer 30 in an original position. Thereafter, in order to use the cosmetics or the cosmetic tools, when the user pushes the locking holder 20 in the direction indicated by arrow (A), the cover 50 and the drawer 30 open simultaneously.

That is, when the user pushes the locking holder 20, since the locking hook 21 and the key projection 22*a* of the locking holder 20 move backward, the hook groove of the cover 50 is released from the locking hook 21 and the cover 50 is opened by the biasing force of the opening spring part 16. Simultaneously, the stopper 32*a* of the drawer 30 is released from the key projection 22*a* and the guiding groove 32 is released from the key projection 22*a*. Therefore, the drawer 30 is pushed out by the biased force of the elastic spring 12*a*.

After the user uses the cosmetics and the cosmetic set, in order to return to the original position, when the user pushes an outside wall 33 of the drawer 30 inwardly, the guiding groove 32, which is disposed on the exterior of the bottom of the drawer 30 presses down on the key projection 22*a* and simultaneously an inside wall 34 of the drawer 30 presses the elastic spring 12*a* disposed within the pair of walls 12. After the stopper 32*a* of the guiding groove 32 of the drawer 30 moves over the key projection 22*a*, the drawer 30 arrives in the receiving room 13.

Also, when the user closes the cover 50, the connection plate 54 of the cover 50 presses the opening spring part 16 of the housing 10 to close due to the operation of the pair of pivot pins disposed within the pair of pivot pin holders 53 of the cover 30 and the pivot pin receiver 71 of the housing. The hook groove 52 of the cover 30 then engages the locking hook of the housing 10. Accordingly, the drawer 30 and the cover 50 are locked in their original position as shown in FIG. 1.

Figure 7:
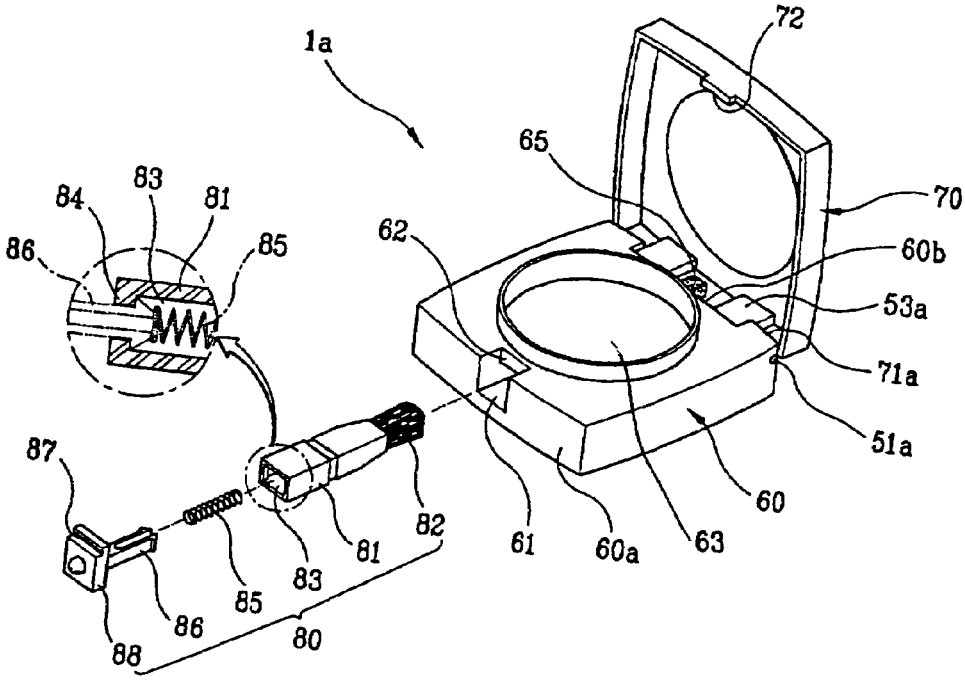
FIG. 7 is a second embodiment of the cosmetics case, according to the present invention.
Figure 8:
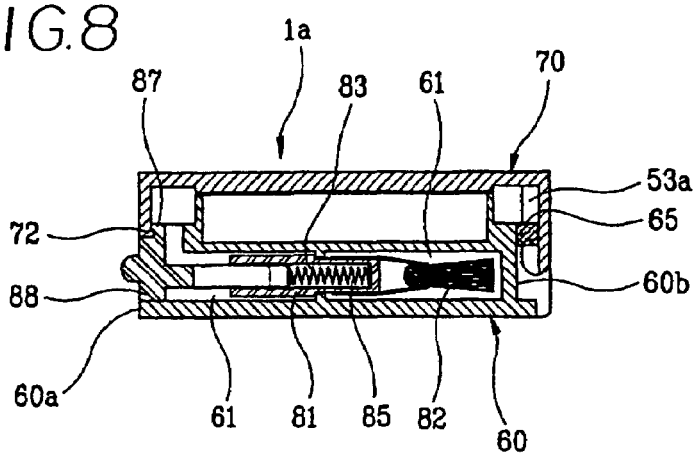
FIG. 8 is a sectional view of the second embodiment of the cosmetics case, according to the present invention.

Referring in detail to FIGS. 7 and 8, there is illustrated a second embodiment of a cosmetics case 1*a* according to the present invention. The cosmetics case 1*a* includes a housing 60, a cover 70 pivotally attached to the housing 60, and a cosmetic set 80 movably disposed within the housing 60. The cover 70 has a mirror 50*a* adhered on the inside surface thereof, and a hook groove 72.

The housing 60 includes an elongated space 61 disposed at the front wall 60*a*, a raised portion 62 disposed at the entrance of the elongated space 61, and an opening spring part 65 disposed on a rear wall 60*b* of the housing 60. The cover 70 is pivotally connected to the housing 60 by a pair of pivot pins 51*a* through a pair of pivot pin holders 53*a* of the cover 70 and a pair of pivot pin receivers 71*a*.

The cosmetic set such as the cosmetic brush 80 includes a body 81, a brush 82 disposed at the inside end of the body 81, a chamber 83 disposed within the body 81, a pushing element 88 having a locking hook 87, a stopping part 86, and a spring 85 connected to the stopping element 86. The stopping element 86 is stopped by a body projection 84 of the body 81.

Referring to FIGS. 7 and 8, the cosmetics case 1*a* according to the present invention operates as follows. The cosmetics case 1*a* provides for the cosmetics (not shown) in a cosmetics receiving room 63 and provides for the cosmetic brush 80 in the elongated space 61 of the housing 60, in an original position. Thereafter, in order to use the cosmetics and/or the cosmetic brush 80, when the user pushes the pushing element 88, the cover 70 and the cosmetic brush 80 open simultaneously.

That is, when the user pushes the pushing part 88 lightly, the hook groove 72 is released from the blocking groove 87 and at the same time, the cover 70 is opened by the biased force of the opening spring part 65. Also, simultaneously, the locking groove 87 is released from the raised portion 62 of the housing 60 and the cosmetic brush 80 is pushed out from the elongated space 61 of the housing 60 by the biased force of the spring 85. The cosmetic brush 80 can be replaced with any other types of cosmetic tool according to the user's preference.

After the user has used the cosmetics and/or the cosmetic brush 80, the user pushes the cosmetic brush 80 by pushing the pushing part 88 into the elongated space 61 and closes the cover 70 by engaging the hook groove 72 with the locking groove 87. Accordingly, the cosmetic brush 80 and the cover 70 are closed, so that the cosmetic case 1*a* returns to its original position as shown in FIG. 8.

Figure 9:
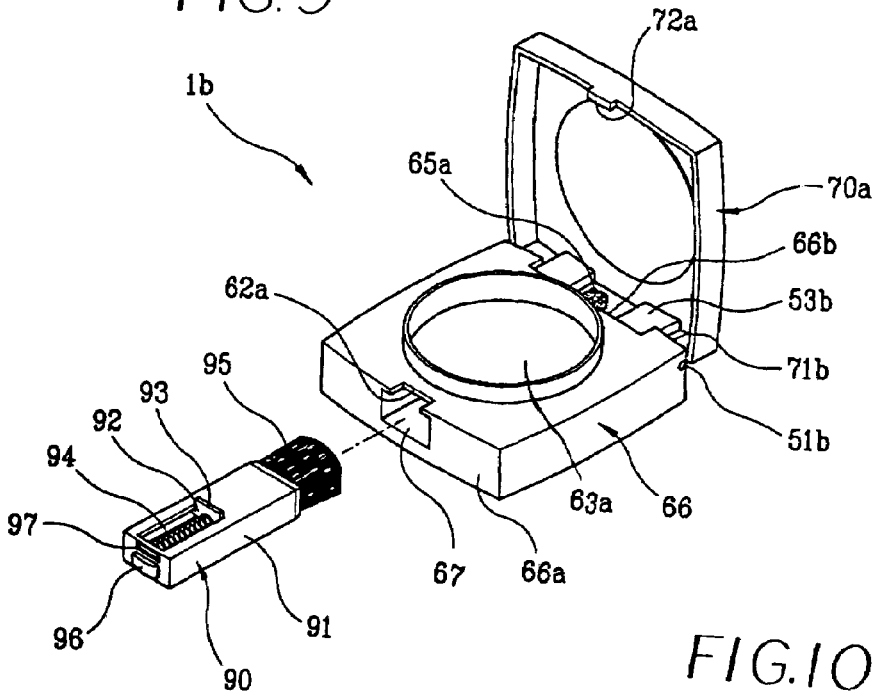
FIG. 9 is a third embodiment of the cosmetics case, according to the present invention.
Figure 10:
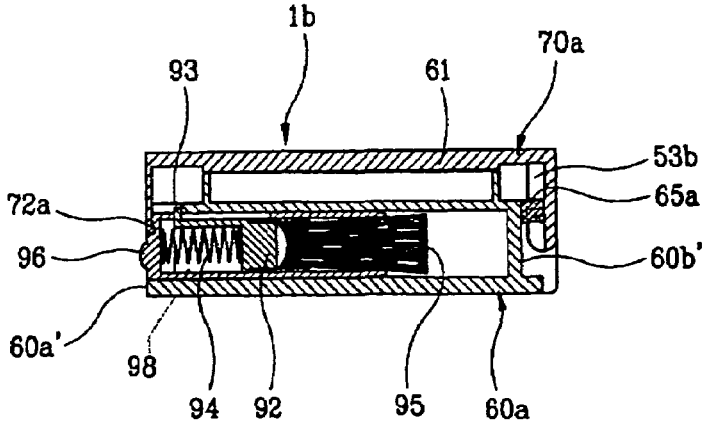
FIG. 10 is a sectional view of the third embodiment of the cosmetics case, according to the present invention.

Referring in detail to FIGS. 9 and 10, there is illustrated a third embodiment of the cosmetics case 1*b* according to the present invention. The cosmetics case 1*b* includes a housing 66, a cover 70*a* pivotally mounted to the housing, and a cosmetic set such as a cosmetic brush 90 movably disposed within an elongated space 67 of the housing 66. The cover contains a mirror 50*a* adhered on the inside surface thereof and a hook grove 72*a*.

The housing 66 includes an elongated space 67 disposed from a front wall 66*a*, a raised portion 62*a* disposed at the entrance of the elongated space 67, and an opening spring part 65 disposed on a rear wall 66*b* of the housing 66. Also, the cover 70*a* is pivotally mounted to the housing 66 by a pair of pivot pins 51*b* through a pair of pivot pin holders 53*b* of the cover 70*a* and a pair of pivot pin receivers 71*b*.

The cosmetic brush 90 includes a body 91, a brush 95, disposed at an inside end of the body 91, a chamber 98 disposed within the body 91, a pushing element 96 having a locking groove 97, a spring 94 fixed to a fixing element 92 which is disposed within the hollow 98, and a body projection 93 connected to the fixing part 92 for stopping against the raised portion 62*a* at the entrance of the elongated space 67 of the housing 66.

Referring to FIGS. 9 and 10, the cosmetic case 1*b* according to the present invention operates as follows. The cosmetics case 1*b* accommodates the cosmetics (not shown) in a cosmetics receiving room 63*a* and the cosmetic brush 90 is accommodated in the elongated space 67 of the housing 66, in an original position. Thereafter, in order to use the cosmetics and/or the cosmetic brush 90, when the user pushes the pushing element 96, the cover 70*a* and the cosmetic brush 90 open simultaneously.

That is, when the user pushes the pushing part 96 lightly, the locking hook 72*a* is released from the locking groove 97 and at the same time, the cover 70*a* is opened by the biasing force of the opening spring part 65. Also, the cosmetic brush 90 is pushed from the elongated space 67 of the housing 66 by the biasing force of the spring 84.

After the user uses the cosmetics and/or the cosmetic brush 90, the user pushes the cosmetic brush 90 by pushing the pushing element 96 into the elongated space 67 of the housing 66 and at the same time, the user closes the cover 70*a* by engaging the locking hook 72*a* of the cover 70*a* with the locking groove 97 of the cosmetic brush 90. Accordingly, the cosmetics and the cosmetic brush 90 are closed, so that the cosmetic case 1*b* returns to its original position as shown in FIG. 10.

Accordingly, the cosmetics cases 1, 1*a* and 1*b* according to the present invention include the covers 50, 70 and 70*a*, receptacles 40, 60 and 66 for cosmetics, and cosmetic set receiving drawers 30, 80 and 90 disposed under the receptacles 40, 60 and 66, respectively, whereby when the user pushes the pushing elements 20, 88 and 96, the covers 50, 70 and 70*a* are opened and simultaneously the cosmetic set drawers 30, 80 and 90 are pushed out for conveniently and easily utilizing make-up and make-up implements anywhere and anytime, and facilitating the carrying of the cosmetic cases.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cosmetics case which comprises:

a housing having a cosmetics receiving room disposed on the top thereof;

a cover pivotally mounted to the housing, said cover having a mirror and also a hook groove disposed on the front center thereof;

an elongated chamber extending from a front wall thereof; and a cosmetic brush adapted to be slidably received in the elongated chamber, said cosmetic brush including:

a body member provided with body projections;

a spring disposed within the body member;

a pushing element having a locking hook for engaging with the hook groove of the cover, and including a stopping element extending into the body member for engagement with the body projections; and whereby when the user pushes the pushing element, the cover releases from the locking hook of the cosmetic brush, the cover opens, and simultaneously the cosmetic brush is pushed out.

2. A cosmetic case which comprises:

a housing having a cosmetic receiving room disposed on the top thereof;

a cover pivotally mounted to the housing, said cover having a mirror and also a hook groove disposed on the front center thereof;

an elongated chamber extending from a front wall thereof; and a cosmetic brush adapted to be slidably received in the elongated chamber, said cosmetic brush including:

a hollow chamber;

a spring disposed within the chamber, said spring being attached to a fixing element;

a pushing element attached to the spring, the pushing element having a locking groove for locking to the locking hook of the cover;

whereby when the user pushes the pushing element, the cover releases from the locking hook of the cosmetic brush, the cover opens, and simultaneously the cosmetic brush is pushed out.

* * * * *